United States Patent [19]

Shimada et al.

[11] 4,246,865

[45] Jan. 27, 1981

[54] ONE SIDE SURFACE MOLTEN METALLIC COATING APPARATUS

[75] Inventors: Shoji Shimada, Kamakura; Yasunobu Matsushima, Kawasaki; Yokichi Sato, Kodaira; Kuniharu Matsumoto, Yokohama; Kazuyuki Akeyoshi, Yamato; Takayuki Tobita, Yokohama, all of Japan

[73] Assignees: Asahi Glass Company Limited; Nihon Parkerizing Co., Ltd., both of Tokyo, Japan

[21] Appl. No.: 876,335

[22] Filed: Feb. 9, 1978

[30] Foreign Application Priority Data

| | | | |
|---|---|---|---|
| Feb. 15, 1977 | [JP] | Japan | 52-14587 |
| Feb. 15, 1977 | [JP] | Japan | 52-14588 |
| Feb. 15, 1977 | [JP] | Japan | 52-14589 |

[51] Int. Cl.[3] ..... C23C 1/00; B05C 3/18

[52] U.S. Cl. ..... 118/65; 118/410; 118/419; 427/57; 427/434.3

[58] Field of Search ..... 427/57, 434 A, 300, 427/259; 228/180 R, 260; 118/419, 65, 67, 410

[56] References Cited

U.S. PATENT DOCUMENTS

| | | | |
|---|---|---|---|
| 1,318,740 | 10/1919 | Fessenden | 427/DIG. 8 |
| 3,098,370 | 7/1963 | Poole | 427/DIG. 8 |
| 3,121,019 | 2/1964 | Blay | 427/259 |
| 3,149,987 | 9/1964 | Crandall | 427/259 |
| 3,228,788 | 10/1966 | Teplitz | 427/428 |
| 3,266,136 | 3/1963 | Gutbier | 228/260 |
| 3,277,566 | 10/1966 | Cristensen | 228/180 R |

FOREIGN PATENT DOCUMENTS

| | | | |
|---|---|---|---|
| 2734370 | 2/1978 | Fed. Rep. of Germany | 427/57 |
| 2656524 | 6/1978 | Fed. Rep. of Germany | 427/300 |
| 51-80626 | 7/1976 | Japan | 427/57 |
| 52-134826 | 11/1977 | Japan . | |
| 846961 | 9/1960 | United Kingdom . | |

*Primary Examiner*—Ralph S. Kendall

*Attorney, Agent, or Firm*—Oblon, Fisher, Spivak, McClelland & Maier

[57] ABSTRACT

One side surface of a strip of metal is contacted with a surface of a molten metal bath which is locally raised under ultrasonic vibration whereby a continuous coating is attained on one side only.

A tool for imparting the ultrasonic vibration to a bath is immersed near the bath surface and the ultrasonic vibrator connected to the tool is contained in hollow holding means dipped in the bath.

In accordance with the apparatus of the present invention, the worn tool can be exchanged for a short time and the molten metallic coating on one side only of the strip of metal can be attained for a long time.

15 Claims, 10 Drawing Figures

ONE SIDE SURFACE MOLTEN METALLIC COATING APPARATUS

BACKGROUND OF THE INVENTION

1. Field of the Invention

The present invention relates to a one side surface molten metallic coating apparatus for coating on one side only of a substrate such as a sheet or strip of metal.

2. Description of the Prior Art

It has been developed to use strips coated on one side only which are prepared by coating a molten metal on one side only to improve anticorrosive and soldering characteristics and which are used in cars and household electric instruments etc.

An electric plating process has been known as the process for preparing a strip of metal coated on one side only. In the electric plating process, the productivity is low and the cost is high in order to prepare a sheet or strip of metal on which a large amount of molten metal is coated. Moreover, the process could not applied for coating aluminum etc.

On the contrary, if a hot dipping process for coating a strip of metal by immersing it in a molten metal bath, can be applied on one side only, the advantages are remarkable from the economical and technical viewpoints. Various processes have been proposed.

U.S. Pat. Nos. 3,149,987 and 3,121,019 disclose the processes for coating on one side only by coating sodium bentonite or an alkaline earth hydroxide on a rear surface to form a coating and immersing it in a molten metal bath and then, removing the coating of sodium bentonite or an alkaline earth hydroxide. These processes include the step of coating a resist on the rear surface and the step of removing the resist after the molten metallic coating whereby the processes are remarkably complicated and the resist coated on the rear surface contaminates the molten metal bath and the contaminated molten metal is coated to cause difficulties.

It has not been found any satisfactory process for coating a molten metal on one side only.

In order to overcome the disadvantages, it has been developed to apply a process for coating on one side only by contacting one side only of a substrate with a molten metal bath which is locally raised by applying ultrasonic vibration to the molten metal.

However, when the coating process is continuously applied for a long time, the edge of the tool for ultrasonic vibration is gradually wore and an uniformly coated product can not be obtained.

SUMMARY OF THE INVENTION

It is an object of the present invention to provide a one side surface molten metallic coating apparatus in which a worn tool for ultrasonic vibration can be exchanged in a short time so as to attain the molten metallic coating on one side only of a long substrate such as a sheet or strip of metal for a long time.

The foregoing and other objects of the present invention have been attained by providing a one side surface molten metallic coating wherein a ultrasonic vibrator connected through a horn to a tool for ultrasonic vibration is contained in a hollow holding means held in the molten metal bath.

DETAILED DESCRIPTION OF THE PREFERRED EMBODIMENTS

Figure 1:
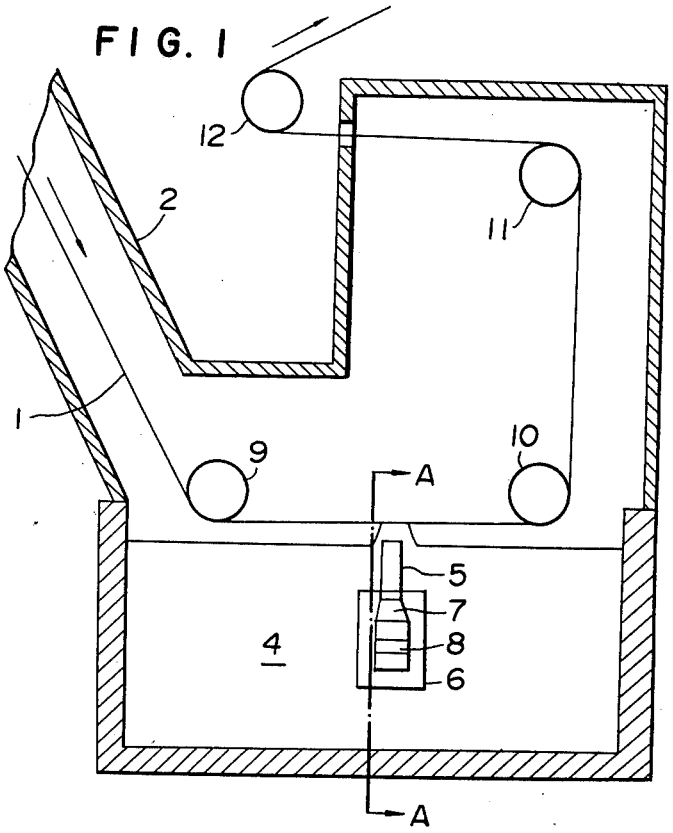
FIG. 1 is a schematic sectional view of one embodiment of the apparatus of the present invention.

Referring to the drawings, the present invention will be illustrated.

FIG. 1 shows one side surface molten metallic coating apparatus according to the present invention and the apparatus is disposed following a reduction furnace in line annealing continuous coating (galvanizing) method such as Sendzimir method or following a heating furnace in the out of line annealing continuous coating (galvanizing) method.

A strip of metal (1) is continuously fed through a snout part (2) into the one side surface molten metallic coating apparatus which is kept in a reduction atmosphere. A molten metal bath (4) is disposed below the apparatus. A tool (5) for ultrasonic vibration is disposed by immersing it in the molten metal bath to raise the molten metal surface. A hollow holding means (6) contains an ultrasonic vibrator (8) connected through the horn (7) to the tool (5). The direction of running the strip (1) is varied to the horizontal direction by a guide roll (9) disposed slightly above the raised molten metal surface whereby the lower surface of the strip is contacted with the raised molten metal to be wetted that is, to form a molten metallic coating.

The direction of running the strip (1) is varied by the second guide roll (10) to leave the molten metal surface and to run upwardly. The strip is run out of the apparatus through a guide roll (11) disposed above the molten metal surface and is fed through a roll (12) to a looper for the post-treatment.

Figure 2:
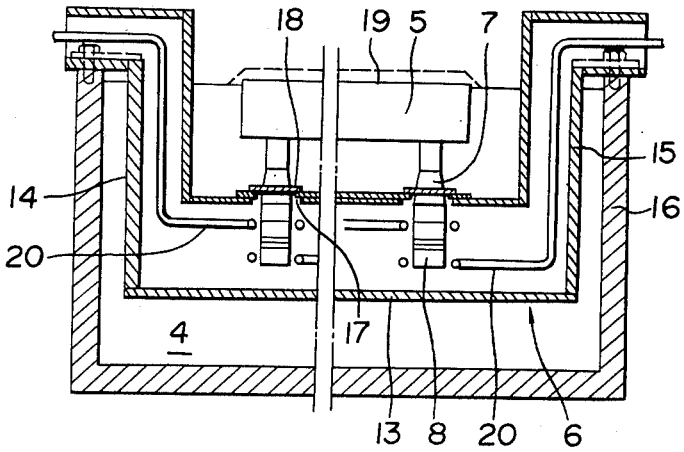
FIG. 2 is a partially enlarged sectional view taken along the line of A—A in FIG. 1.

As shown in FIG. 2, the tool (5) for ultrasonic vibration having substantially the same length with the width of the strip is immersed molten metal bath in the perpendicular to the running direction of the strip. A plurality of horns (7) are connected to the tool with predetermined gaps and the ultrasonic vibrator (8) is connected to the horns (7).

The hollow holding means (6) for holding the tool (5) and the ultrasonic vibrator (8) comprises a hollow part (13) for containing the ultrasonic vibrator and air inlets (14), (15) for communicating the hollow part and the atmosphere which are connected to the ends of the hollow part (13). The hollow holding means is fixed on a vessel for bath at the air inlet part opening to the atmosphere.

Communicating holes (17) are formed corresponding to the horns at the upper surface of the hollow part (13) and the horns are fixed at the communicating holes parts by holders (18) and the tool for ultrasonic vibration and the ultrasonic vibrator are fixed by the hollow holding means and the flow of the molten metal into the hollow part is prevented.

The distance of the fixed position for fixing the horn and the hollow part from the free edge (19) of the tool (5) is preferably $\frac{1}{4}$ or odd times of $\frac{1}{4}$ of the wavelength whereby the amplitude is preferably minimum.

A cooling tube (20) is arranged around the ultrasonic vibrator contained in the hollow part. The overheating of the ultrasonic vibrator by the molten metal is prevented by passing a liquid coolant through the cooling tube. The air inlets opening to the atmosphere are used for preventing the overheating of air in the hollow part and high pressure in the hollow part.

It is also possible to connect the air inlets to a blower whereby the ultrasonic vibrator is cooled with air and with the liquid coolant.

Figure 3:
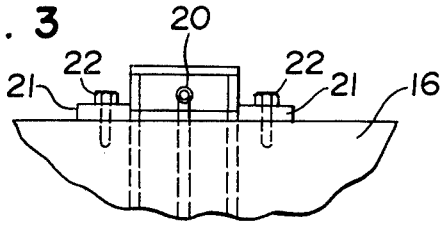
FIG. 3 is a partially enlarged side view of FIG. 2.

When the hollow holding means is fixed, as shown in FIG. 3, the hollow holding means is fixed on the molten metal bath vessel (16) with bolts (22) by the fittings (21) provided at the opening to the atmosphere. Thus, the free edge (19) of the tool (5) is disposed at the position being slightly exposing above the molten metal bath during no ultrasonic vibrations by the hollow holding means fixed on the molten metal bath vessel.

When the ultrasonic vibration is applied to the tool (5) by the apparatus the molten metal surface above the free edge (19) is raised as shown by the dotted line. When the strip of metal is run while contacting the raised molten metal surface with one side only of the strip, the surface of the strip contacted with the molten metal bath, is immediately wetted by the action of the ultrasonic vibration.

The free edge of the tool of ultrasonic vibration is transmitting the ultrasonic vibration to the bath whereby the free edge is gradually worn by the cavitation effect depending upon the time for the operation.

When the free edge of the tool is worn, the molten metal bath surface could not be uniformly raised whereby the tool should be exchanged to a new tool because it is difficult to attain an uniform coated layer.

In accordance with the present invention, when the hollow holding means is disassembled by disconnecting the bolts (22) and it is taken out from the molten metal bath vessel, the tool for ultrasonic vibration held in the hollow holding means can be taken out together with the hollow holding means and new hollow holding means holding a new tool for ultrasonic vibration is fixed on the molten metal bath vessel to exchange the worn tool to the new tool.

The fittings of the hollow holding means are disposed at the positions which do not contact with the molten metal bath whereby the exchange of the tool can be attained under the condition maintaining the molten metal bath and the time required for exchanging the tool can be shortened and the coating operation can be continued for a long time.

Figure 4:
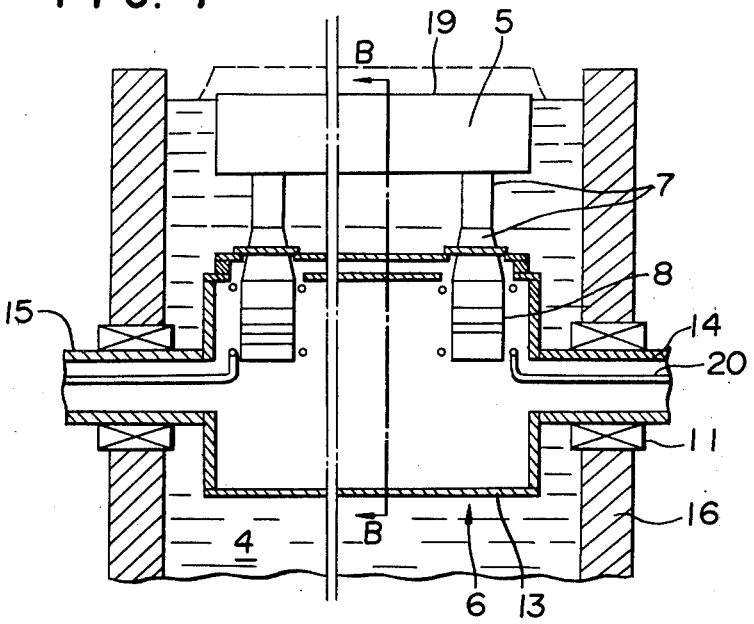
FIG. 4 is a schematic sectional view of another embodiment of the apparatus of the present invention.

FIG. 4 shows another embodiment of the apparatus of the present invention. As the same with the embodiment of FIG. 2, the tool for ultrasonic vibration (5) having substantially same length with the width of the strip of metal is immersed in the perpendicular to the direction running the strip of metal near the molten metal surface. The lower part of the tool (5) is connected through the horns (7) to a plurality of ultrasonic vibrators (8).

The hollow holding means (6) containing the tool and the ultrasonic vibrators comprise the hollow part (13) having a hollow cylindrical shape and containing the ultrasonic vibrators and the air inlets (14), (15) connected to the hollow part for communicating the hollow part to the atmosphere. The air inlets are rotatably held on the molten metal bath vessel while passing through the vessel (16).

The communicating hole (17) corresponding to the horn is formed on the curved surface of the cylindrical hollow part in the direction being parallel to the shaft and the horn is fixed on the communicating hole part with the fittings (18) and the tool for ultrasonic vibration and the ultrasonic vibrator are fixed on the hollow holding means and the ultrasonic vibrator is sealed from the molten metal.

Figure 5:
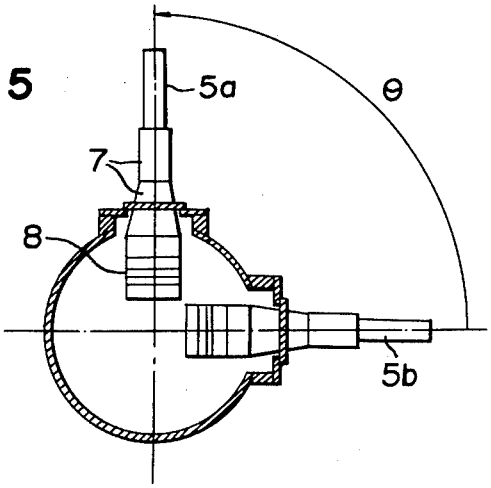
FIG. 5 is a partially enlarged sectional view taken along the line B—B.

As shown in FIG. 5, a plurality of tools (5*a*), (5*b*) are held in the hollow part in radial to the rotary shaft and the tools respectively are connected through the horns (7) to the ultrasonic vibrators (8). The ultrasonic vibration is applied independently to each of the tools.

As the same with the embodiment of FIG. 2, the hollow part is communicated through the air inlet opening to the atmosphere and the ultrasonic vibrator contained in the hollow part is cooled by a cooling tube (2) with a liquid coolant.

When the tool (5*a*) disposed near the molten metal surface is worn, the new tool (5*b*) can be shifted to the position of (5*a*) by turning the hollow holding means for an angle of $\theta$ and the ultrasonic vibration can be applied to the tool 5*b* to continue the molten metal coating operation. When the tool 5(*b*) is worn, the other tool can be shifted to the position (5*a*) by further turning the hollow holding means.

In the embodiment, the exchange of the tool (5) can be attained only by turning the hollow holding means whereby the exchange is attained in a short time and the molten metal coating can be continuously attained for a long time and the embodiment is especially preferable for coating one side only of the strip of metal with zinc. The sectional view of the hollow part of the apparatus of the present invention is not limited to a circular shape but it can be various shapes such as polygonal shape, elliptic shape, etc.

Figure 6:
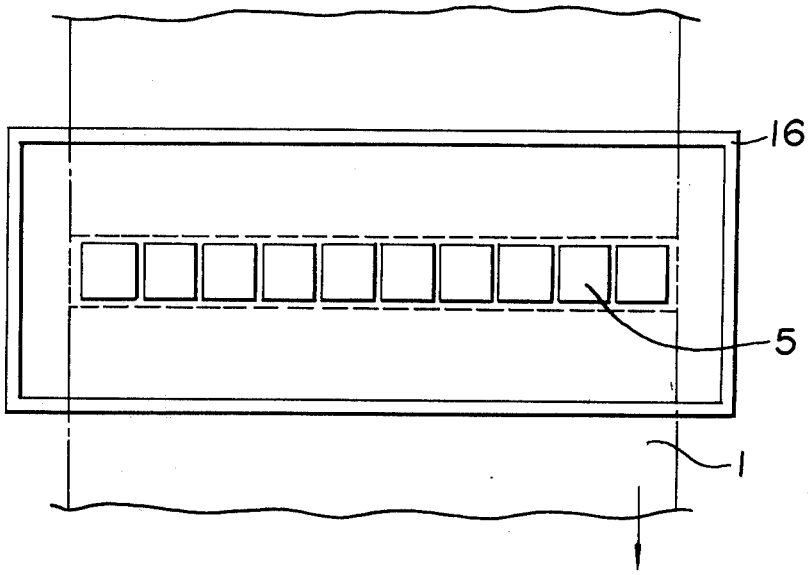
FIG. 6 is a plan view of the other embodiment of the apparatus of the present invention.

The tools shown in FIGS. 2 and 4 have substantially the same length with the width of the strip. Thus, as shown in FIG. 6 it is possible to aline tools (5) having short length perpendicular to the direction of running the strip so as to be substantially the same with the width of the strip.

In these cases, the width of the tool is preferably less than about $\frac{1}{3}$ to $\frac{1}{4}$ of the wavelength. When it is more than $\frac{1}{3}$ of wavelength, it is difficult to transmit uniform ultrasonic vibration on the free edge of the tool whereby the molten metal bath surface is nonuniformly raised.

The adjacent tools are preferably arranged to give each distance between the centers of the tools to be about $\frac{1}{3}$ to $\frac{1}{4}$ of wavelength. When the ultrasonic vibration is applied to the tools, the molten metal surface is uniformly raised as shown by the dotted line whereby the one side surface molten metallic coating on the strip can be attained as the embodiments of FIGS. 2 and 4.

Figure 7:
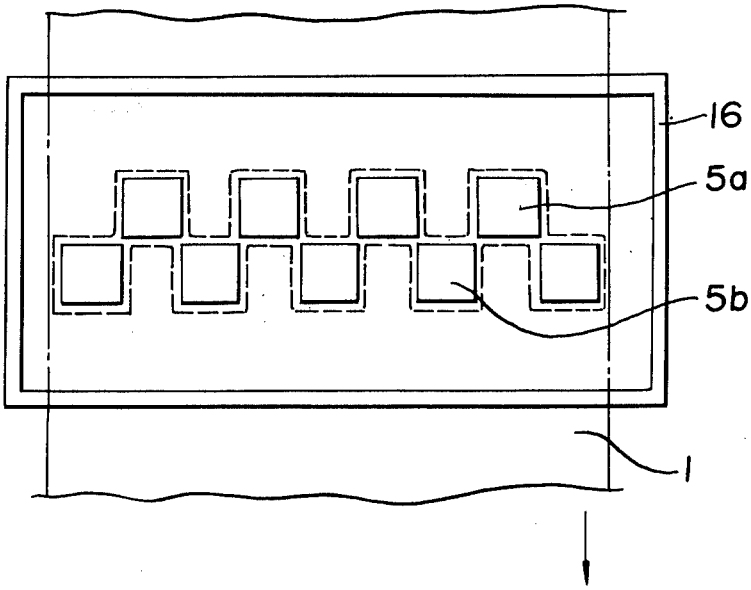
FIG. 7 is a plan view of the other embodiment of the apparatus of the present invention.

In the embodiment shown in FIG. 7, the tools (5*a*) are alined in the perpendicular to the direction running the strip (1) with a specific gap. The other tools (5*b*) are respectively aline in these gaps, whereby the molten metal surface which is not raised by the tools (5*a*), can be raised by the tool (5*b*) in the transversal direction to the strip, that is, the parts shown by the dotted line are raised to attain the result as the same with that of FIG. 6.

In the embodiments shown in FIGS. 2, 4 and 6, the tools are alined to the running direction of the strip. Thus, when two or more lines of the tools are arranged, the one side surface molten metallic coating on the strip can be attained at higher speed.

Figure 8:
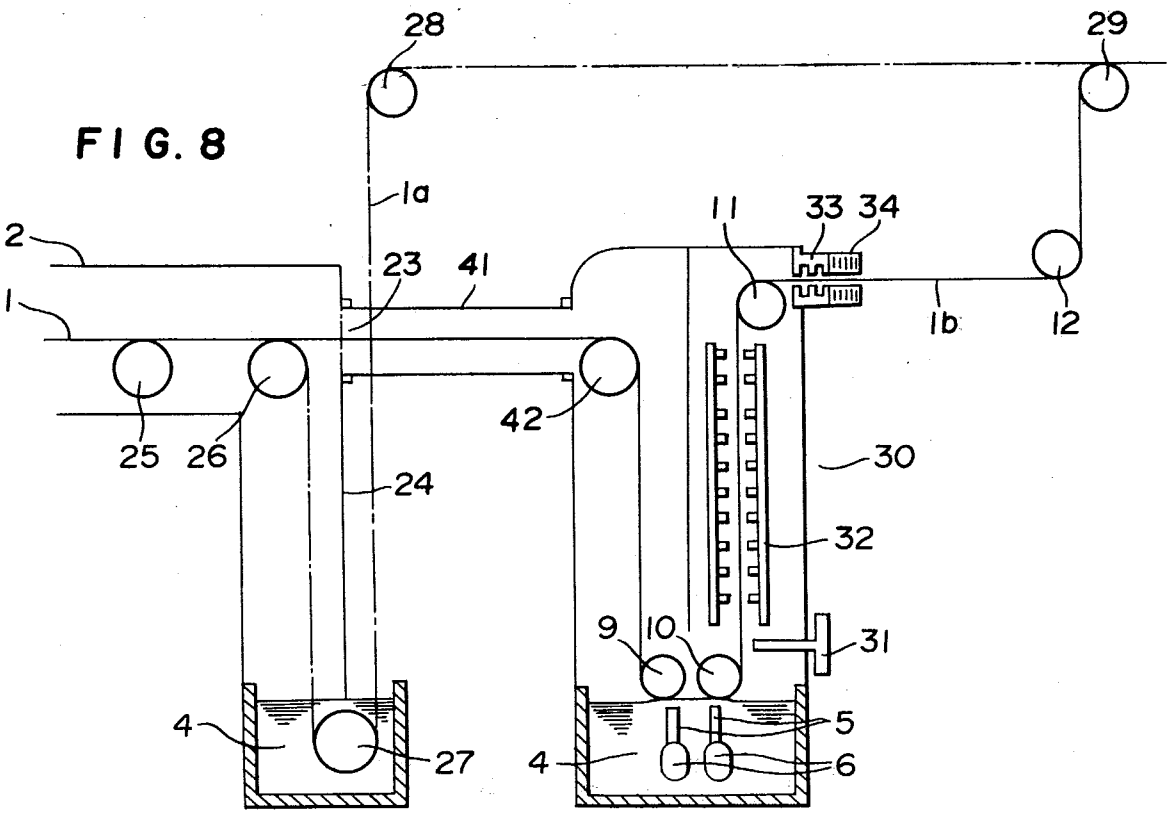
FIG. 8 is a schematic view of the other embodiment of the apparatus of the present invention.

FIG. 8 shows a schematic view of the combination of the both side surface molten metallic coating apparatus and the one side surface molten metallic coating apparatus utilizing the wheeling type molten metallic coating apparatus for the strip of metal. The reference numeral (2) designates a snout of temperature controlling means for controlling the temperature by preheating or cooling the strip of metal so as to be suitable for the molten metal coating, and (23) designates a connection to the one side surface molten metallic coating apparatus. The both side surface molten metallic coating apparatus 24 equipped with the molten metal bath (4) is disposed below the temperature controlling means (2).

The both side surface molten metallic coating is carried out by running the strip (1) through a roll (25), a deflector roll (26) and downwardly to be guided by a roll 27 in the molten metal bath (4). The metal coated strip (1) is taken out of the both side surface molten metallic coating apparatus and it is turned by a deflector roll (28) to the horizontal direction and fed through a roll (29) to a looper for the post-treatment (not shown).

In the embodiment, the one side surface molten metal coating apparatus (30) is disposed after the both side surface molten metallic coating apparatus (the strip running side). The reference numeral (41) designates a conduit for directly feeding the strip (1) from the temperature controlling means (2) above the both side surface molten metal coating apparatus to the one side surface molten metal coating apparatus. The connection between the temperature controlling means of the both side surface molten metallic coating apparatus and the one side surface molten metallic coating apparatus is sealable so as to prevent a leakage of the atmosphere (reduction atmosphere) at the temperature controlling means.

The strip (1) is passed through the conduit (41) and turned downwardly by the guide roll (42) disposed above the one side surface molten metal coating apparatus and reached to the molten metal bath (4). The reference numeral (6) designates hollow holding means containing the ultrasonic vibrator and it is disposed in the molten metal bath and (5) designates a tool for ultrasonic vibration connected to the ultrasonic vibrator and the tool is extended near the molten metal surface whereby the molten metal surface near the top of the tool is raised.

The one side surface of the strip is contacted with the raised molten metal surface under turning by guide rolls (9), (10) disposed just above the molten metal surface. The reference numeral (31) designates a gas wiping device or an air knife disposed just above the molten metal surface to control the amount of the coated metal. The strip (1*b*) coated on one side only of the strip is fed into a jet quenching device (32) equipped with many nozzles for ejecting a coolant gas or liquid. The strip coated with the molten metal is quenched, the quenched strip is turned to the horizontal direction by a roll (11) disposed above the jet quenching device (32) and the strip (1) is taken out of the apparatus through an outlet (33) sealed by an atmospheric gas curtain which is disposed above the one side surface molten metal coating apparatus. The strip coated on one side surface is further cooled by a water cooling device (34) for cooling the strip which is adjacent to the outlet (33). The strip (1) is fed through the roll (12) and the roll (29) to the looper for the post-treatment.

In the one side surface molten metal coating apparatus, the strip coated with a molten metal such as zinc is quenched with the atmospheric gas by the jet quenching device (32) and further cooled by the water cooling device (34) at the outlet to about 200° C. whereby a thickness of a membrane of iron oxide formed on the non-coated surface can be less than 300 Å and a phosphate membrane having excellent anticorrosive characteristics can be formed by treating it in the conventional phosphate bath.

The present invention can be also applied for the wheeling type or the selas type molten metal coating apparatus. In these cases, a flux can be coated at suitable position front of the temperature controlling means. It is preferable to coat the flux only on the surface being coated.

The operation for the one side surface molten metallic coating has been illustrated. In the case of the both side surface molten metallic coating, the connection (23) beween the conduit (41) and the temperature controlling means (2) is sealed and the molten metallic coating is carried out by the conventional method.

In accordance with the present invention, the one side surface molten metallic coating apparatus can be provided in the conventional molten metallic coating apparatus by simple remodelling to prepare a strip coated by the one side surface molten metallic coating. The both side surface molten metal coating and the one side surface molten metal coating can be switched depending upon the needs.

The strip coated on one side only prepared by the present invention has excellent characteristic for chemical treatment.

Figure 9:
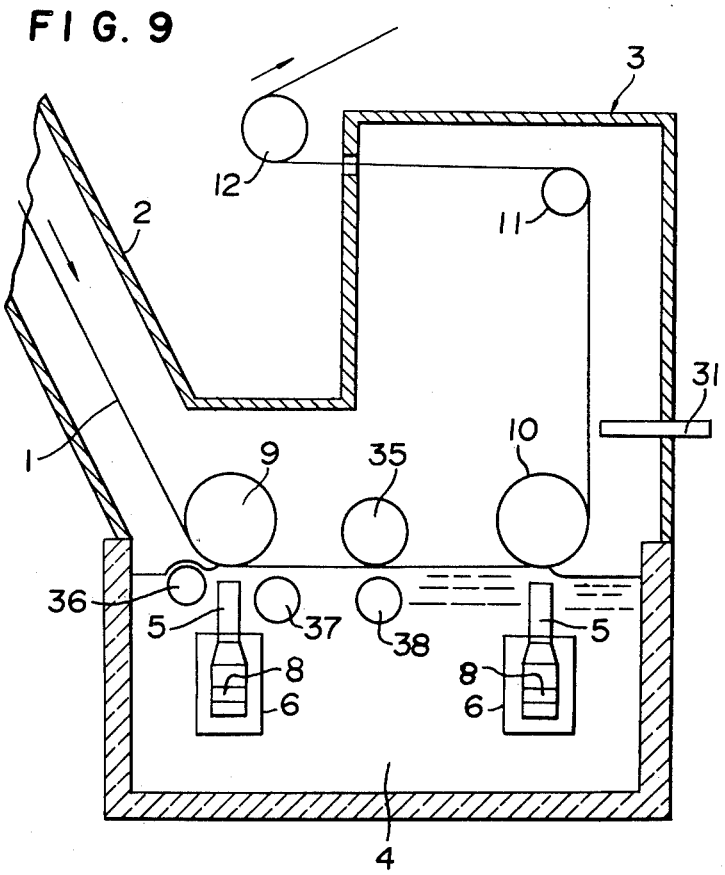
FIG. 9 is a schematic view of the other embodiment of the apparatus of the present invention.

FIG. 9 shows the other embodiment of the present invention wherein a tension roll (35) for imparting tension to the strip (1) is provided between the guide rolls (9), (10).

The guide rolls (9), (10) and the tension roll (35) disposed near the molten metal surface can be finely adjusted the vertical positions thereof so as to adjust the gap between the molten metal surface and the lower surface of the roll.

Rotary rolls (36), (37), (38) respectively have the shafts in the perpendicular to the direction of running the strip and the rotary rolls are dipped in the molten metal bath while vertically being movable.

The rotary roll can be provided in front of the first tool (5) as the roll (36) and also can be provided after the first tool (5) as the roll (37) and also can be provided at about middle of two tools below the tension roll (35). The rotary direction of the rotary roll can be the same with the direction running the strip or the opposite direction. The raise of the molten metal surface is assisted by the rotation of the rotary roll or the feed of the molten metal under the strip running at high speed is smoothly attained whereby the molten metal coating on the lower surface of the strip is uniformly attained.

The rotary speed of the rotary roll is controlled so as to give the peripheral speed of 10 to 1500 m/min. depending upon the speed of the strip and the relation of positions of the roll and the tool for ultrasonic vibration. The speed of the strip is decided depending upon the length of the reduction furnace, the oxidation furnace and the heating furnace; the heating cycle; the heating method; and the thickness of the strip.

The rotary rolls can be made of cast steel, cast iron, ceramics etc. and can have a smooth surface or a matted surface or a decorated pattern surface so as to easily raise the molten metal.

Figure 10:
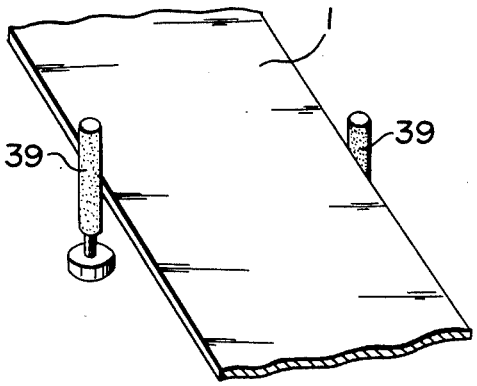
FIG. 10 is a schematic view of the other embodiment of the apparatus of the present invention.

FIG. 10 shows one embodiment of the apparatus for coating a resist (protective material) at both side edges of the strip (1).

The apparatus is disposed at up-stream side to the snout of the apparatus shown in FIG. 1.

The resist is coated on both edges of the strip by the coating rolls (39) made of a felt or the other material which are disposed in the longitudinal direction while contacting with both edges of the strip.

The strip is then, fed into the heating furnace wherein the thermal decomposition of the resist is resulted to form the oxide coatings on the edges of the strip.

When the metal oxide formed by the thermal decomposition as the resist has a surface energy being smaller than that of the molten metal especially the molten zinc, the surface of the resist is not wetted by the molten metal. Accordingly, an aqueous solution, a dispersion containing the metal compound or a resin is used.

Suitable composition can be a silicon resin, a colloidal silica solution and a water glass solution; or an aqueous solution or dispersion of one or more phosphates, nitrates or formates of metals such as Ba, Sr, Cd, Pb, Zn, Al and B. A surfactant and a chelating agent, etc., can be added to the aqueous solution or dispersion so as to improve the stability of the solution and the stability of the dispersion.

When the one side surface molten metallic coating on the strip is attained by the apparatus of the present invention, if the speed of the strip is too fast, the strip runs under a vertical vibration between the guide rolls (9), (10). The amplitude of the vibration is increased dependent upon the speed of the strip and the thinness of the strip. For example, when the strip having a thickness of less than 1 mm is run at a rate of 100 m/min, the vibration having an amplitude of several mm is caused. When the height of the raised molten metal surface is small the strip is dipped into the molten metal by the vibration, whereby the molten metal is adhered on the uppon surface for non-coating. Accordingly, it is necessary to decrease the speed of the strip so as not to cause vertical vibration of the strip. The molten metal coating can be attained at higher speed by increasing the height of the raised molten metal surface.

The height of the raised molten metal surface can be higher depending upon desposing the upper surface of the tool i.e. the free edge to be higher at the non-ultrasonic vibration or applying higher energy of ultrasonic vibration of the free edge. However, if the position of the free edge is too high, the unstable raised molten metal surface is caused or no raised molten metal surface is caused. In order to form stable raised molten metal surface, it is necessary to expose the free edge of the tool for up to 5 mm especially up to 3 mm from the molten metal surface at non-ultrasonic vibration.

When the energy of ultrasonic vibration applied to the free edge of the tool is too small, the height of the raised molten metal surface is low or is not found.

When the energy is too large, the molten metal is scattered and a stable raised molten metal surface is not formed and the scattered molten metal is adhered on the non-coated surface. The energy of ultrasonic vibration is preferably 5 to 50 watt/cm$^2$ especially 10 to 30 watt/cm$^2$.

When the free edge of the tool is exposed from the molten metal surface at the non-ultrasonic vibration, the higher raised molten metal surface is formed whereby the molten metal is not adhered on the non-coating surface and the one side surface molten metal coating can be advantageously attained at high speed even though the strip is run at high speed for causing slight vertical vibration.

What is claimed as new and desired to be secured by Letters Patent of the United States is:

1. A one side surface molten metallic coating apparatus comprising:

a vessel containing a molten metal bath having an upper level, said molten metal having zinc as a main component;

at least one hollow holding means contained in said molten metal bath;

at least one tool immersed in said bath, each said at least one tool being fixed to a horn and having one surface adjacent said upper level; and at least one ultrasonic vibrator for each said at least one tool, each said vibrator being positioned in one of said at least one hollow holding means and fixed to one of said horns, whereby each said vibrator may vibrate said one of said tools to raise said upper level adjacent said tool so that a running metal strip immersed adjacent said one surface of one of said at least one tool may be coated on one side.

2. An apparatus according to claim 1 wherein the hollow holding means comprises a hollow part for containing the ultrasonic vibrator and at least one air inlet part connected to said hollow part and communicating the hollow part to the atmosphere.

3. An apparatus according to claim 2 wherein two inlet parts are provided, one connected to each end of the hollow part and each of said air inlet parts are fitted to said vessel.

4. An apparatus according to claim 2 wherein the hollow part is cylindrical and one air inlet part is connected to each end of the hollow part and the air inlet parts are rotatably held on said vessel and a plurality of radially extending tools are circumferentially disposed on the curved surface of the hollow part.

5. An apparatus of claim 1 wherein the tool has substantially the same length as the width of said strip and is arranged transverse to the direction of running of said strip and a plurality of ultrasonic vibrators are connected to the tool with predetermined gap between said vibrators.

6. An apparatus according to claim 5 wherein adjacent ultrasonic vibrators are arranged so that the distance between the centers of the ultrasonic vibrators is $\frac{1}{3}$ to $\frac{1}{4}$ of a wavelength.

7. An apparatus according to claim 5 wherein a plurality of tools are disposed in the direction of running of said strip.

8. An apparatus according to claim 1 wherein a plurality of tools are closely arranged in one line transverse to the direction of running of said strip.

9. An apparatus according to claim 8 wherein a plurality of tools are arranged in the direction of running of said strip.

10. An apparatus according to claim 1 wherein at least one rotary roll having a rotary shaft extending in the transverse direction of the running of said strip is immersed in the molten metal bath adjacent said upper level and said at least one rotary roll is rotated.

11. An apparatus according to claim 1 which further comprises a coater for coating a protective material on the edges of said strip prior to said one side coating, said protective material forming an oxide being non-wettable by the molten metal due to a thermal decomposition, whereby the adhesion of the molten metal on the non-coating surfaces is prevented.

12. An apparatus according to claim 1 wherein said one surface of the tool is exposed above said upper level of said molten metal bath during no ultrasonic vibration.

13. An apparatus according to claim 12 wherein the upper surface of the tool extends up to 3 mm from said molten metal upper level during no ultrasonic vibration.

14. The apparatus according to claim 1 wherein a plurality of said tools are arranged in alternating rows, each said row extending in the transverse direction to the direction of running of said strip and separated from adjoining rows in said running direction, said tools of said rows being spaced with predetermined gaps therebetween, and wherein each of the tools of each of said rows are positioned adjacent one of said gaps of each of the adjacent rows.

15. The apparatus of claim 1 which further comprises:

a strip temperature controlling means adapted to contain said running strip and positioned upstream from said one side surface coating apparatus in the direction of running of said strip;

a both side surface molten metallic coating apparatus for immersion coating a running metal strip;

a first conduit connecting said temperature controlling means to the upstream end of said one side surface coating apparatus; and a second conduit connecting said temperature controlling means to the upstream end of said two side surface coating apparatus, whereby both one side and both side coating may be performed on a single line.

* * * * *